US006564562B1

(12) United States Patent
Wang et al.

(10) Patent No.: US 6,564,562 B1
(45) Date of Patent: May 20, 2003

(54) GENERATOR SOLUTION OUTLET BOX FOR AN ABSORPTION CHILLER

(75) Inventors: Fenfei Wang, Onalaska, WI (US); Luan K. Nguyen, Holmen, WI (US)

(73) Assignee: American Standard International Inc., New York, NY (US)

( * ) Notice: Subject to any disclaimer, the term of this patent is extended or adjusted under 35 U.S.C. 154(b) by 0 days.

(21) Appl. No.: 10/045,981

(22) Filed: Jan. 10, 2002

(51) Int. Cl.[7] ..... F25B 15/00
(52) U.S. Cl. ..... 62/141; 62/489; 62/476
(58) Field of Search ..... 62/141, 489, 497, 62/148, 101, 103, 476; 122/19.1, 19.2

(56) References Cited

U.S. PATENT DOCUMENTS

| | | | | |
|---|---|---|---|---|
| 2,321,929 A | | 6/1943 | McGinnis | |
| 3,279,212 A | | 10/1966 | Aronson | |
| 3,626,710 A | | 12/1971 | Porter | |
| 3,771,320 A | * | 11/1973 | Kenneryd et al. | 62/476 |
| 4,454,726 A | | 6/1984 | Hibino et al. | |
| 4,475,361 A | | 10/1984 | Alefeld | |
| 5,062,371 A | * | 11/1991 | Lavorel | 110/214 |
| 5,160,163 A | * | 11/1992 | Castagner et al. | 280/740 |
| 5,253,523 A | * | 10/1993 | Bernardin | 62/476 |
| 5,381,674 A | | 1/1995 | Omori et al. | |
| 5,551,254 A | | 9/1996 | Inoue | |
| 5,592,825 A | | 1/1997 | Inoue | |
| 5,692,393 A | | 12/1997 | Klintworth et al. | |
| 6,009,714 A | | 1/2000 | Tanaka et al. | |
| 6,408,643 B1 | | 6/2002 | Takabatake et al. | |

FOREIGN PATENT DOCUMENTS

JP 04283365 A * 10/1992

* cited by examiner

*Primary Examiner*—Chen Wen Jiang
(74) *Attorney, Agent, or Firm*—William J. Beres; William O'Driscoll

(57) ABSTRACT

An absorption apparatus includes a generator with an integrated outlet box comprising a liquid sensing chamber and a solution outlet chamber. The sensing chamber has an opening into the generator, with the opening being sized according to the liquid surface area inside the sensing chamber. The outlet chamber has a larger opening into the generator to provide a more open flow path for solution to exit the generator through the outlet chamber. The more restricted opening in the sensing chamber allows a liquid level sensor therein to sense a relatively calm liquid level that tends to be at an average elevation of a boiling-disrupted liquid level in the generator. With the opening in the sensing chamber being appropriately sized, a variable speed pump, responsive to the liquid level sensor, controls the flow of solution into the generator to maintain a desired solution liquid level in the generator.

29 Claims, 2 Drawing Sheets

FIG. 2
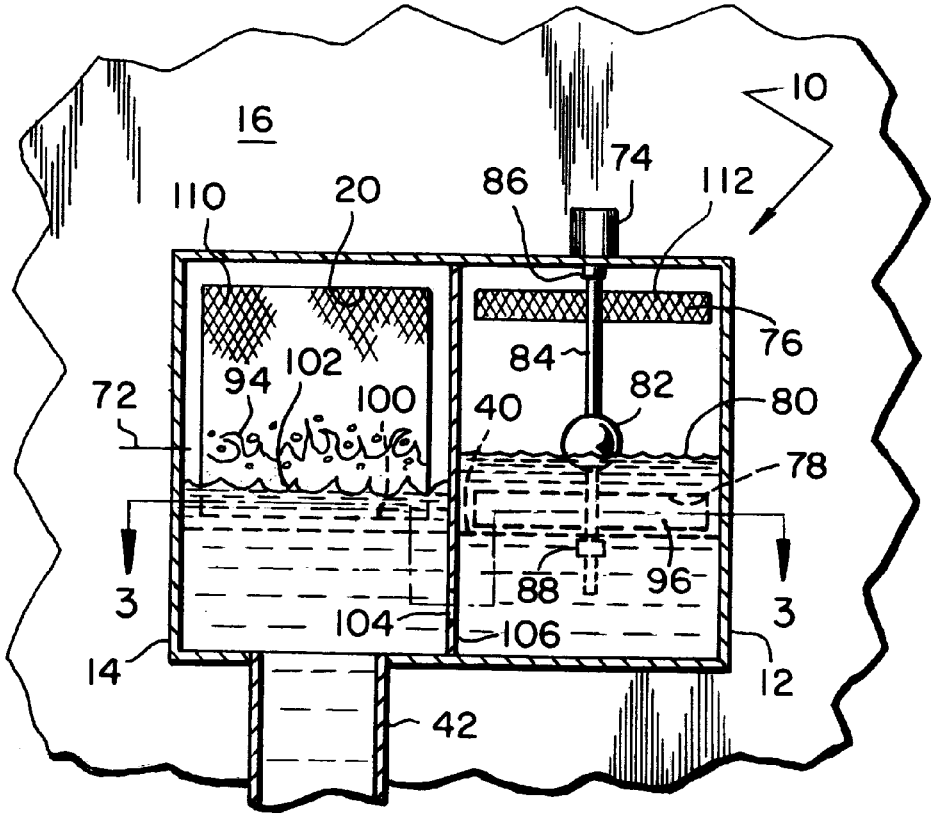
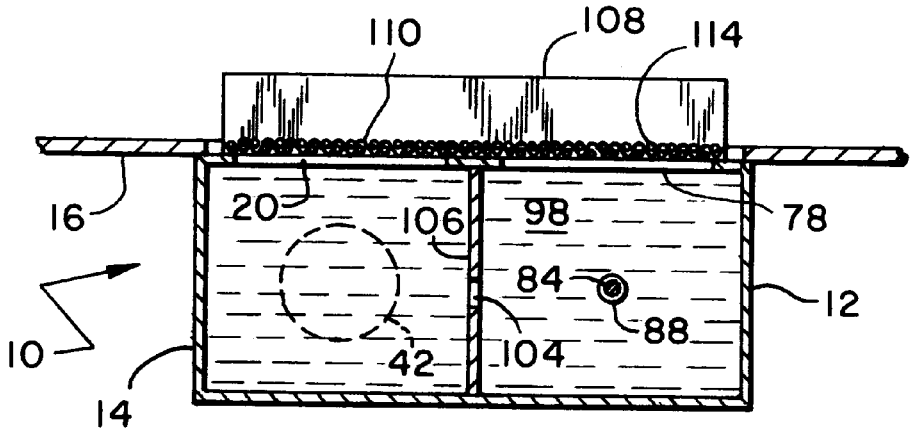
FIG. 3

GENERATOR SOLUTION OUTLET BOX FOR AN ABSORPTION CHILLER

BACKGROUND OF THE INVENTION

1. Field of the Invention

The present invention relates to a generator of an absorption cooling system. More particularly, the present invention relates to a solution outlet box for the generator.

2. Description of Related Art

Typical absorption chillers have a working solution from which a refrigerant is cyclically vaporized and reabsorbed to provide a cooling effect. Common solutions consist of water and lithium bromide with water being the refrigerant, or ammonia and water, in which case the ammonia is the refrigerant.

In operation, the solution is heated within a generator to vaporize the refrigerant from the solution. For a solution of lithium bromide and water, the water vaporizes, while the remaining solution becomes more concentrated with lithium bromide. For absorption systems using a solution of ammonia and water, the ammonia is the vaporized component.

Vaporizing the refrigerant raises the pressure in the generator. From the generator, the concentrated solution returns to an absorber, while the refrigerant vapor moves into a condenser and condenses there. The liquid refrigerant then enters a lower-pressure evaporator and vaporizes as the refrigerant removes heat from chilled water. The chilled water can then be used as needed, such as to cool rooms or other areas of a building. At the same time, concentrated solution inside the absorber absorbs refrigerant vapor coming from the evaporator and reduces the pressure inside the evaporator to a desired level. Concentrated solution absorbing refrigerant vapor creates a solution of dilute concentration. The dilute solution is then pumped back to the generator to perpetuate the solution separation process.

Properly operating an absorption chiller involves controlling several interrelated variables of the solution. Some of the variables include the temperature, pressure, flow rate, concentration and liquid level of the solution in the generator. Controlling the liquid level in the generator is particularly important, as failure to do so can disrupt absorption chiller operations.

For example, if the liquid level gets too high, violent boiling inside the generator can cause undesirable concentrated solution to be carried over into the condenser and significantly reduce the chiller's cooling capacity. High liquid levels in the generator may starve the absorber of solution, which may lead to cavitation of the pump that draws solution from the absorber. Excess liquid head in the generator can also cause inefficient vapor generation.

Conversely, if the liquid level in the generator is too low, some heat transfer surfaces may not be submerged, which can possibly damage those surfaces and reduce the chiller's performance. A prolonged low liquid level can starve a solution outflow pipe that passes concentrated solution from the generator to the absorber and results in losing a liquid seal between the generator and the absorber. Starving the solution outflow pipe of liquid can cause destructive water hammer and/or diminish the effectiveness of a heat exchanger that may be connected in series with the outflow pipe.

Maintaining a proper liquid level in the generator can be difficult, as various operating conditions, may disturb the solution's liquid level. For instance, if the chiller's purpose is for cooling a building, a sudden increase in the building's cooling demand may require the generator to generate more vapor by rapidly boiling more solution. Upon doing so, the level of solution in the generator may drop dramatically. A pump drawing solution from the outlet of the absorber could replenish the generator with more solution; however, as the building's cooling demand is satisfied, the generator may cool down, and the actual liquid level may overshoot the desired level.

To maintain the liquid level in the generator at a proper level, many devices and control schemes have been developed. One of the more common devices is known as an outlet box. A typical outlet box provides various functions, which may include: providing an outlet for concentrated solution to leave the generator, providing a vapor/liquid seal between a generator and an absorber, and maintaining a proper liquid level in the generator. Various examples of outlet boxes are disclosed in U.S. Pat. Nos. 3,279,212; 4,475,361; 5,381,674 and 5,551,254.

Each of the patents discloses the basic operating function of a particular outlet box; however, the patents discussion of certain control issues, response time in particular, is limited or nonexistent. Failure to address the issue of response time may result in an ineffective outlet box that prevents an absorption chiller from operating at its full potential.

Consequently, a need exists for an absorption apparatus that addresses the issue of response time to avoid control problems such as overshoot, slow response, and hunting.

SUMMARY OF THE INVENTION

It is an object of the present invention to balance the flow of solution through an absorption chiller under dramatic cooling load changes by providing the generator with an integrated outlet box that includes a liquid level sensing chamber and a liquid outlet chamber.

Another object of the invention is to maintain a desired liquid level over the generator outlet by controlling the operation of a solution pump system in response to the measurement from a liquid level sensor inside the liquid level sensing chamber. For a quick, consistent indication of the average solution level inside the generator, the liquid level sensing chamber is provided with a liquid opening for passing solution to and from the generator, wherein the liquid opening is sized according to the surface area of the solution inside the liquid level sensing chamber. The sensing chamber also includes a vapor opening that allow vapor to pass between the generator and the level sensing chamber.

To smooth out the boiling effects of the liquid level in the generator, it is an object of some embodiments of the invention to provide the liquid level sensing chamber with a liquid opening whose area is less than the surface area of the solution that is inside the chamber.

To limit the time delay of the liquid level inside the sensing chamber following the liquid level inside the generator, it is also an object to provide the liquid level sensing chamber with a liquid opening whose area is at least a half-percent the surface area of the solution that is inside the sensing chamber.

To further provide a good measurement of the liquid level in the generator, it is an object of the invention to provide the liquid level sensing chamber with a liquid opening whose area is between ten to fifty percent of the area of the liquid surface area of the solution that is inside the chamber.

Another object of the invention is to divide the integrated outlet box with a common dividing wall that is shared by the liquid level sensing chamber and the liquid outlet chamber.

Another object is to provide the common dividing wall with a hole that is open to the liquid level sensing chamber and the liquid outlet chamber at their bottoms. The liquid level in the level sensing chamber can then be measured to predict the liquid solution level changes in the generator for better solution flow control when the chiller is under dramatic cooling load changes. If the absorption chiller is not running, the hole will allow the concentrated solution in the level sensing chamber to drain.

Yet, another object of the invention is size the hole in the common dividing wall so that it is no more than a fourth the size of the surface area of the solution that is inside the liquid level sensing chamber. This helps minimize adverse effects of flow through the hole when the solution's liquid level is above the liquid opening in the liquid level sensing chamber.

Yet still another object is to provide an outlet box that helps keep the liquid level in the outlet chamber near the liquid level in the generator when the chiller is running. To do this, the liquid outlet chamber is provided with a relatively large opening into the generator, wherein the opening is larger than the liquid opening in the liquid level sensing chamber.

A further object is to have the opening in the liquid outlet chamber be larger than the hole in the common dividing wall to help maintain a relatively calm liquid surface in the liquid level sensing chamber.

A still further object is provide the liquid opening of the liquid level sensing chamber with a width greater than its height to help distribute the opening over a uniform elevation.

Another object of the invention is to keep the liquid opening of the liquid level sensing chamber relatively close to the opening in the liquid outlet chamber, so that the liquid level in the liquid level sensing chamber responds closely to amount of solution flowing into the outlet chamber.

Another object is to use the integrated outlet box to maintain a liquid seal between the generator and an absorber, thus helping to ensure that a solution-to-solution heat exchanger is kept flooded with liquid solution.

Another object is to use the integrated outlet box to safeguard the minimum liquid level inside the generator by aligning all openings for passing liquid solution to the required minimum liquid solution level of the generator. If the chiller is running and the liquid level in the level sensing chamber is lower than the minimum required level, the level sensor will inform the unit controller to take appropriate actions.

Another object is to use the integrated outlet box to safeguard the maximum liquid level inside the generator by aligning all openings for passing vapor higher than the required maximum liquid solution level of the generator. If the chiller is running and the liquid level in the level sensing chamber is higher than the maximum required level, the level sensor will inform the unit controller to take appropriate actions.

Another object is to provide the integrated outlet box with a deflector plate that helps block the solution flowing upward along the side of the generator. Blocking such flow provides for better correlation between the liquid level in the level sensing chamber and the solution outflow from the generator.

Another object is have screens cover all openings between the generator and the integrated outlet box to protect the heat exchanger on the return line and to improve the vapor-liquid separation in the outlet chamber.

These and other objects of the invention are provided by an absorption apparatus that includes a generator in fluid communication with a liquid level sensing chamber and a liquid outlet chamber. The liquid sensing chamber is provided with an opening into the generator, with the opening being sized according to the liquid surface area of the solution that is inside the liquid level sensing chamber. The liquid outlet chamber is provided with a significantly larger opening into the generator. The larger opening provides a more open flow path for solution to exit the generator through the liquid outlet chamber. The more restricted opening in the liquid level sensing chamber allows a liquid level sensor therein to sense a relatively calm liquid level that tends to be at an average elevation of a boiling-disrupted liquid level in the generator. With the opening in the liquid level sensing chamber being appropriately sized, a solution pump system controlled in response to the liquid level sensor can effectively maintain a desired solution liquid level in the generator under a wide range of chiller operating conditions.

BRIEF DESCRIPTION OF THE DRAWINGS

FIG. 2 shows the integrated outlet box of the generator of FIG. 1, but with the outlet box shown in a cross-sectional view taken along line 2—2 of FIG. 1.

FIG. 3 shows the integrated outlet of the generator of FIG. 1, but with the outlet box shown in a cross-sectional view taken along line 3—3 of FIG. 2.

DESCRIPTION OF THE PREFERRED EMBODIMENT

Figure 1:
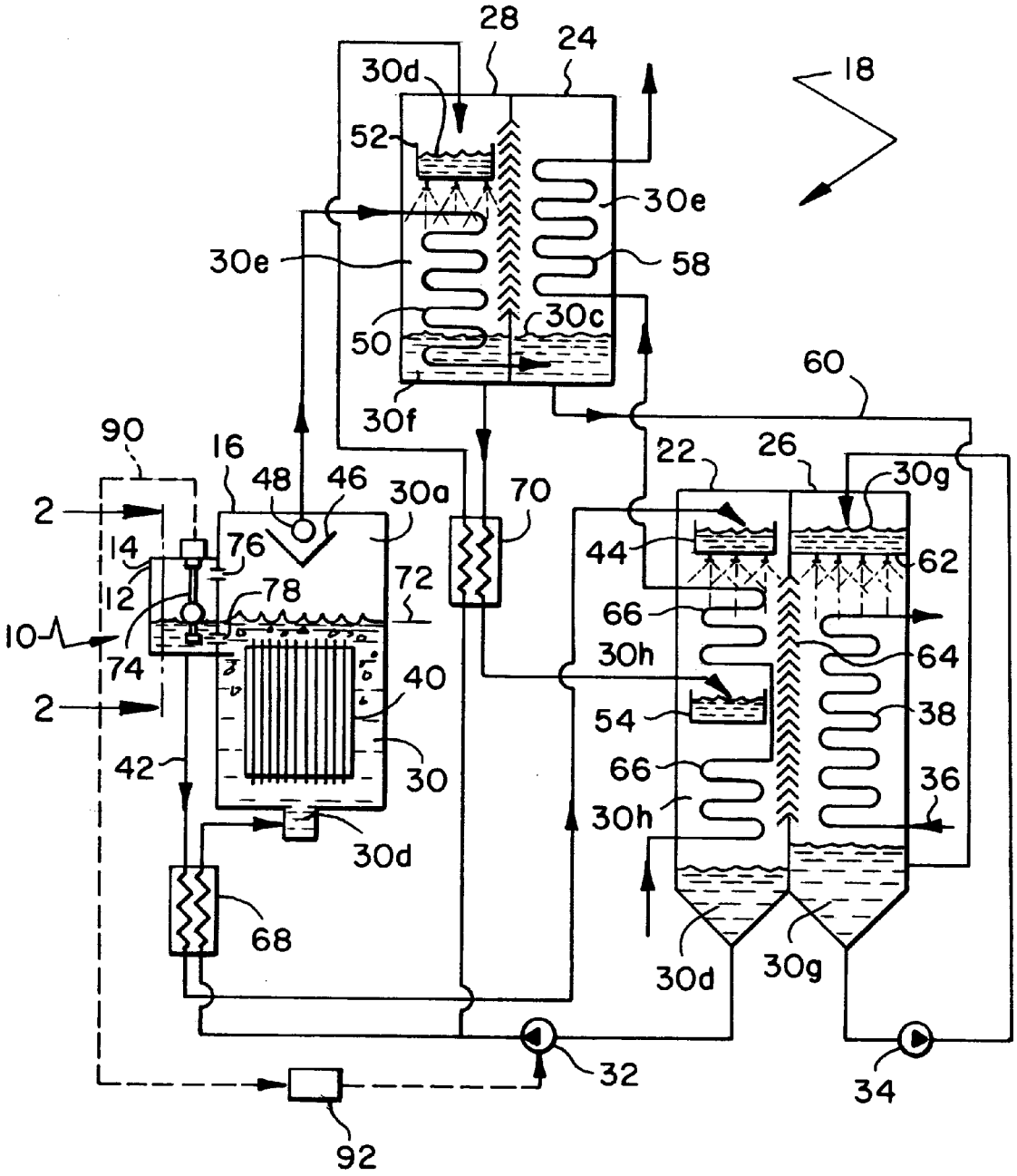
FIG. 1 is a schematic diagram of an absorption chiller with a generator that includes an integrated outlet box according to one embodiment of the invention.

An integrated outlet box 10, comprising a liquid level sensing chamber 12 and a liquid outlet chamber 14, is shown attached to a generator 16 of an absorption chiller 18 in FIG. 1, with further details of outlet box 10 shown in FIGS. 2 and 3. Outlet box 10 serves several functions including, but not limited to, providing a solution outlet opening 20 for concentrated solution to leave generator 16, maintaining a proper liquid level in generator 16, and providing a liquid seal between generator 16 and an absorber 22. Before details of outlet box 10 are explained, an overview of absorption chiller 18 will first be discussed.

Major components of chiller 18 include a high temperature generator 16, a condenser 24, an evaporator 26, absorber 22 and a low temperature generator 28 (low temperature simply meaning a temperature generally lower than that of the high temperature generator). Chiller 18 also includes an absorption solution 30, which is any solution having at least one part that can be separated from and reabsorbed into another part. Chiller 18 will be described with reference to solution 30 consisting of water and lithium bromide; however, other solutions, such as ammonia and water, are also well within the scope of the invention. Throughout chiller 18, the concentration of solution 30 may range from a weak to a strong solution, with a strong solution having a relatively high concentration of lithium bromide. The water (i.e., pure or nearly pure water), when separated from the solution, may be referred to as refrigerant whose phase may vary from a liquid state to a vaporous or gaseous state. The broader term, "fluid" encompasses solution 30 (in any concentration), liquid refrigerant, vaporous refrigerant and any combination thereof.

Solution pump 32 moves solution 30 into generators 16 and 28 to maintain the solution flow through the various components of chiller 18 for the final purpose of chilling water 36. Water 36 is chilled upon passing through a heat exchanger 38 disposed in evaporator 26, and can be conveyed to wherever chilled water 36 may be needed. For example, chilled water 36 can be circulated through another heat exchanger (not shown) for cooling a room or area within a building. The process of chilling water 36 will now be explained with a description of the various components of chiller 18, starting with high temperature generator 16.

Generator 16 includes a heat exchanger 40 that boils solution 30 to separate solution 30 into water vapor 30*a* and a higher concentrated solution 30*b* (liquid water with a high concentration of lithium bromide). Concentrated solution 30*b* exits generator 16 through outlet opening 20 in outlet box 10 and is conveyed through a solution outflow pipe 42 to an upper reservoir 44 in absorber 22. Meanwhile, vapor 30*a* passes through a vapor separator 46 before exiting through a vapor outlet 48.

From vapor outlet 48, water vapor 30*a* begins condensing upon passing through a heat exchanger 50 in low temperature generator 28. The resulting condensate or water vapor 30*a* discharges to mix with refrigerant 30*c* that collects as water condensate at the bottom of condenser 24. An upper reservoir 52 in low temperature generator 28 directs a dilute liquid solution 30*d* to pass across heat exchanger 50. The heat from vapor 30*a* in heat exchanger 50 vaporizes solution 30*d* to create a water vapor 30*e* and a strong liquid solution 30*f*. Strong solution 30*f* collects at the bottom of low temperature generator 28 and is then conveyed to a lower reservoir 54 in absorber 22. Water vapor 30*e* in low temperature generator 28 passes through a vapor separator 56 to enter condenser 24. A heat exchanger 58, conveying relatively cool water from an external source (e.g., from a conventional cooling tower), condenses vapor 30*e*. The resulting condensate collects as refrigerant 30*c* at the bottom of condenser 24 to mix with other condensate from water vapor 30*a* condensing inside heat exchanger 50 of low temperature generator 28.

Liquid refrigerant 30*c* is conveyed by line 60 to lower pressure evaporator 26, where refrigerant 30*c* mixes with refrigerant 30*g*. A pump 34 delivers refrigerant 30*g* from the bottom of evaporator 26 to a reservoir 62 that is above heat exchanger 38 in evaporator 26. Absorber 22 continuously draws refrigerant vapor from evaporator 26 to maintain a low pressure in evaporator 26. The low pressure allows the refrigerant in evaporator 26 to vaporize and cool chilled water 36, as reservoir 62 directs refrigerant 30*g* across heat exchanger 38.

In absorber 22, reservoirs 44 and 54 direct strong solution 30*b* and 30*f* (from generators 16 and 28, respectively) across the surface of a heat exchanger 66, which cools the strong solution by water from an external source. As this occurs, the strong solution 30*b* and 30*f* absorbs refrigerant vapor 30*h* and collects as dilute solution 30*d* at the bottom of absorber 22. To complete the cycle, pump 32 pumps dilute solution 30*d* to replenish the supply of solution in generators 16 and 28. As solution 30*d* is conveyed to generators 16 and 28, solution-to-solution heat exchangers 68 and 70 help preheat solution 30*d* by recovering the otherwise wasted heat from the solution leaving the generators.

Pump 32 can be part of a pump system that is controlled to deliver solution 30*d* into generator 16 in a way that maintains a certain target liquid level 32 in generator 16 (e.g., a target liquid level of approximately 1.5-inches above a lower edge of solution outlet opening 20. In a preferred embodiment of the invention, this is accomplished by adjusting the speed of pump 32. However, other control schemes that vary the flow rate are also well within the scope of the invention. For example, the pump system could comprise a pump and a separate flow control valve (e.g., a powered variable flow restriction). The control could also be based on a simple on-off method, wherein pump 32 turns on when the liquid level is below a lower limit and turns off when the liquid level reaches an upper limit.

Sensing the actual liquid level in generator 16 can be difficult, as solution 30 may be actively boiling, which can greatly disturb the liquid surface area in generator 16. Thus, a liquid level sensor 74 is sheltered inside liquid level sensing chamber 12. Chamber 12 includes a vapor opening 76 and a liquid opening 78 that are respectively above and below target liquid level in chamber 12 (e.g., liquid level 80). Liquid opening 78 allows liquid solution 30 to flow between sensing chamber 12 and the interior of generator 16, while vapor opening 76 prevents vaporous solution 30*a* from being trapped within chamber 12. Liquid opening 78, when appropriately sized, creates a relatively calm liquid surface 80 in chamber 12, and liquid surface 80 is at an elevation that tends to follow the average liquid level in generator 16. So, sensor 74 measures the liquid level in chamber 12 to obtain an indication of the liquid level in generator 16.

Sensor 74 has been schematically illustrated to encompass the wide variety of liquid level sensors that are readily available and well known to those skilled in the art. For example, sensor 74 could include a float 82 that is free to slide along a sensing rod 84 between two stops 86 and 88. In a preferred embodiment of the invention, sensor 74 generates a signal 90 whose value varies with the position of float 82 relative to rod 84. It is also conceivable to have a conventional on-off float with a deadband between upper and lower limits. Regardless, signal 90 (or an on-off signal in the case of the on-off float) can then be conveyed to a controller 92, which in turn controls the operation of pump 32 in any conventional manner known to those skilled in the art. Controller 92 is schematically illustrated to encompass a wide variety of controls, examples of which include, but are not limited to, a electromechanical relay; PLC (programmable logic controller); computer or microprocessor; or simple hard wiring, wherein electrical contacts of a float switch are wired directly to the pump's motor starter.

To achieve a desired response time for controlling a liquid level 94 in generator 16, an open area 96 of liquid opening 78 should be within a specific range relative to an area 98 of liquid surface 80 of the solution inside sensing chamber 12 (when the solution is at a predetermined target elevation between openings 76 and 78). For perhaps a marginally acceptable response time, a ratio of area 96 to area 98 should be greater than 0.005 and less than one, based on a mathematical model. A more optimum response time has been found to occur when the ratio of area 96 to area 98 is between 0.1 and 0.5, and ideally should be between 0.15 and 0.35. When the ratio is too small, the response time, or process gain, is insufficient to maintain a proper level of solution in generator 16, as pump 32 tends to run at higher speeds and slower speeds longer than it should. Conversely, when the ratio of area 96 to area 98 is too great, the level of solution 30 in sensing chamber 12 tends to rise and fall excessively, as pump 32 overshoots or hunts.

Liquid opening 78 is preferably wider than it is high to help ensure that the entire opening remains submerged when the liquid level of the solution is near its target elevation.

As for outlet chamber 14, the area of solution outlet opening 20 should be sufficiently large to bring the liquid level in solution outlet chamber 14 up close to the liquid level in generator 16 when chiller 18 is running. Outlet opening 20 is preferably larger than liquid opening 78 to provide a sufficiently unrestricted flow path from generator 16 to outlet chamber 14. To help maintain sensing chamber 12 and outlet chamber 14 at the same pressure, the upper edges of vapor opening 76 and solution outlet opening 20 should be at approximately the same height. The bottom edges of both solution outlet opening 20 and liquid opening 78 should also be at approximately the same height (e.g., 0.5-inches above the top of heat exchanger 40). The bottom edge of solution outlet 20 serves as a weir 100, which helps maintain some liquid in outlet chamber 14 even when the liquid level within generator 16 momentarily drops below weir 100. It should be noted that liquid level 94 inside generator 16 is usually higher than a liquid level 102 inside solution outlet chamber 14, because solution 30 normally flows from generator 16 to chamber 14 due to solution outflow pipe 42.

A common dividing plate 106 divides sensing chamber 12 and outlet chamber 14; however, a leveling hole 104 at the bottom of dividing plate 106 allows liquid solution to pass between chambers 12 and 14. So, even if chiller 18 is operating under dramatic cooling load changes, the liquid level in level sensing chamber 12 can still be used to predict changes in the liquid level in generator 16, and thus provide better performance regarding solution flow control. If chiller 18 is not running, hole 104 allows the concentrated solution in level sensing chamber to drain.

It is important to properly size the hole or it may be difficult to control the liquid level in generator 16. Leveling hole 104 should be smaller than liquid opening 78, and a ratio of the area of hole 104 to area 96 of the liquid surface in sensing chamber 12 is preferably between 0.05 and 0.1.

The liquid level throughout generator 16 can vary from one location to another. However, the most critical location is where solution 30 spills over into outlet chamber 14. Thus, liquid opening 78 should be as close as possible to solution outlet 20, and preferably spaced no further apart than the width of liquid opening 78.

To minimize float 82 repeatedly striking upper stop 86 and lower stop 88 on rod 84, the two stops are positioned relative to openings 76 and 78. Upper stop 86 is positioned to establish a maximum upper sensing limit (center point of float 82 when float 82 is up against stop 86) that is approximately one-inch below the upper edge of vapor opening 76, and lower stop 88 is positioned to establish a minimum lower sensing limit that is approximately aligned with the lower edge of liquid opening 78.

To ensure free solution outflow and better correlation between the liquid level in level sensing chamber 12 and the solution outflow from generator 16, a deflector plate 108 is mounted just underneath liquid opening 96 and outlet opening 20. Plate 108 extends into generator 16 to help block an upward current of solution 30 traveling between heat exchanger 40 and a side wall of generator 16. Blocking such flow helps prevent the current of solution from rushing directly into outlet box 10.

Also, the openings between outlet box 10 and the inside of generator 16, such as openings 20, 76 and 78, are covered with a metal screen 110, 112 and 114, respectively, to protect heat exchanger 68 from contamination and to improve the vapor-liquid separation in outlet chamber 14.

Although the invention is described with reference to a preferred embodiment, it should be appreciated by those skilled in the art that other variations are well within the scope of the invention. For instance, outlet box 10 is readily adapted for use with a variety of other absorption chillers having more or less components than the illustrated preferred embodiment. The various components of an absorption chiller can be rearranged in a variety of configurations. The generator (i.e., a single generator or multiple generators), condenser, absorber, and evaporator can be comprised of individual shells interconnected by piping, or be comprised of various combinations of shells that share a common shell wall. Therefore, the scope of the invention is to be determined by reference to the claims, which follow.

We claim:

1. An absorption apparatus, comprising:

a generator shell defining a solution inlet and a solution outlet;

a fluid creating a primary liquid level whose elevation may vary within an interior of the generator shell;

a heat exchanger disposed in the generator shell for boiling the fluid;

a liquid level sensing chamber having a vapor opening and a liquid opening that place the liquid level sensing chamber in fluid communication with the interior of the generator, wherein the vapor opening is above the primary liquid level and the liquid opening is below the primary liquid level to create a secondary liquid level that spans a first area and tends to follow in elevation the primary liquid level, wherein the liquid opening is of a second area that is less than the first area;

a liquid level sensor associated with the secondary liquid level sensing chamber, wherein the liquid level sensor provides a signal in response to changes in elevation of the secondary liquid level;

a pump system adapted to pump the fluid through the solution inlet and into the generator, wherein the pump system operates in response to the signal of the liquid level sensor; and a liquid outlet chamber in fluid communication with the generator via the solution outlet, wherein the liquid outlet chamber has a solution outflow opening that releases the fluid from the liquid outlet chamber and wherein the liquid level sensing chamber and the liquid outlet chamber share a common dividing wall.

2. The absorption apparatus of claim 1, wherein the pump system includes a variable speed pump.

3. The absorption apparatus of claim 1, wherein a ratio of the second area to the first area is greater than 0.005.

4. The absorption apparatus of claim 1, wherein a ratio of the second area to the first area is between 0.1 and 0.5.

5. The absorption apparatus of claim 1, wherein the solution outlet is larger than the second area.

6. The absorption apparatus of claim 1, wherein the liquid level sensing chamber defines a hole between the liquid level sensing chamber and the liquid outlet chamber, the hole being of a third area that is less than the first area and the second area, and wherein the solution outlet is larger than the third area.

7. The absorption apparatus of claim 1, wherein the second area has a width and a height with the width being greater than the height.

8. The absorption apparatus of claim 7, wherein the liquid opening is spaced apart from the solution outlet by a distance that is less than the width of the second area.

9. The absorption apparatus of claim 1, wherein the common dividing wall defines a hole between the liquid level sensing chamber and the liquid outlet chamber, wherein the hole is of a third area that is less than the first area and the second area.

10. The absorption apparatus of claim 1, further comprising a second heat exchanger that defines a first solution flow path and a second solution flow path, wherein the fluid discharged from the pump system passes through the first solution flow path before entering the solution inlet of the generator and the fluid leaving the liquid outlet chamber via the solution outflow opening passes through the second solution path.

11. The absorption apparatus of claim 1, further comprising a screen extending across the liquid opening.

12. The absorption apparatus of claim 1, further comprising a screen extending across the vapor opening.

13. The absorption apparatus of claim 1, further comprising a screen extending across the solution outlet.

14. The absorption apparatus of claim 1, further comprising a deflector plate below the liquid opening and between the generator shell and the heat exchanger.

15. The absorption apparatus of claim 1, further comprising a deflector plate below the solution outlet and between the generator shell and the heat exchanger.

16. An absorption apparatus, comprising:

a generator shell defining a solution inlet and a solution outlet;

a fluid creating a primary liquid level whose elevation may vary within an interior of the generator shell;

a heat exchanger disposed in the generator shell for boiling the fluid;

a liquid level sensing chamber having a vapor opening and a liquid opening that placed the liquid level sensing chamber in fluid communication with the interior of the generator, wherein the vapor opening is above the primary liquid level and the liquid opening is below the primary liquid level to create a secondary liquid level that spans a first area and tends to follow in elevation the primary liquid level, wherein the liquid opening is of a second area that is less than the first area;

a liquid level sensor associated with the secondary liquid level sensing chamber, wherein the liquid level sensor provides a signal in response to changes in elevation of the secondary liquid level;

a pump system adapted to pump the fluid through the solution inlet and into the generator, wherein the pump system operates in response to the signal of the liquid level sensor; and a liquid outlet chamber in fluid communication with the generator via the solution outlet, wherein the liquid outlet chamber has a solution outflow opening that releases the fluid from the liquid outlet chamber and wherein the liquid level sensing chamber defines a hole between the liquid level sensing chamber and the liquid outlet chamber, the hole being of a third area that is less than the first area and the second area.

17. The absorption apparatus of claim 16, wherein a ratio of the third area to the first area is less than 0.25.

18. An absorption apparatus, comprising:

a generator shell defining a solution inlet and a solution outlet;

a fluid creating a primary liquid level whose elevation may vary within an interior of the generator shell;

a heat exchanger disposed in the generator shell for boiling the fluid;

a liquid level sensing chamber having a first opening that places the liquid level sensing chamber in fluid communication with the interior of the generator to create a secondary liquid level that spans a first area and tends to follow in elevation the primary liquid level;

a liquid level sensor associated with the secondary liquid level sensing chamber, wherein the liquid level sensor provides a signal in response to changes in elevation of the secondary liquid level;

a pump system adapted to pump the fluid through the solution inlet and into the generator, wherein the pump system operates in response to the signal of the liquid level sensor;

a liquid outlet chamber in fluid communication with the generator via the solution outlet, wherein the liquid outlet chamber has a solution outflow opening that releases the fluid from the liquid outlet chamber;

a second heat exchanger that defines a first solution flow path and a second solution flow path, wherein the fluid discharged from the pump system passes through the first solution flow path before entering the solution inlet of the generator and the fluid leaving the liquid outlet chamber via the solution outflow opening passes through the second solution path; and a common dividing wall interposed between the liquid level sensing chamber and the liquid outlet chamber.

19. The absorption apparatus of claim 18, wherein the first opening is spaced apart from the solution outlet.

20. The absorption apparatus of claim 18, wherein the first opening is smaller than the solution outlet.

21. The absorption apparatus of claim 18, wherein the common dividing wall defines a hole that is open to the liquid level sensing chamber and the liquid outlet chamber.

22. The absorption apparatus of claim 21, wherein the hole is smaller than the first opening.

23. The absorption apparatus of claim 21, wherein the hole is smaller than the first area.

24. The absorption apparatus of claim 18, wherein the first opening is smaller than the first area.

25. The absorption apparatus of claim 18, wherein the first opening has a width and a height with the width being greater than the height.

26. The absorption apparatus of claim 25, wherein the first opening is spaced apart from the solution outlet by a distance that is less than the width of the first opening.

27. The absorption apparatus of claim 18, wherein the liquid level sensing chamber defines a second opening that is above the secondary liquid level while the first opening is below the secondary liquid level.

28. The absorption apparatus of claim 18, wherein the pump system includes a variable speed pump.

29. An absorption apparatus, comprising:

a generator shell defining a solution inlet and a solution outlet;

a fluid creating a primary liquid level whose elevation may vary within an interior of the generator shell;

a heat exchanger disposed in the generator shell for boiling the fluid;

a liquid level sensing chamber having a vapor opening and a liquid opening that place the liquid level sensing chamber in fluid communication with the interior of the generator to create a secondary liquid level that spans a first area and tends to follow in elevation the primary liquid level, wherein the liquid opening is smaller than the solution outlet, is spaced apart from the solution outlet, and is of a second area that is less than twice the first area;

a liquid level sensor associated with the secondary liquid level sensing chamber, wherein the liquid level sensor provides a signal in response to changes in elevation of the secondary liquid level;

a pump system adapted to pump the fluid through the solution inlet and into the generator, wherein the pump system operates in response to the signal of the liquid level sensor;

a liquid outlet chamber in fluid communication with the generator via the solution outlet, wherein the liquid outlet chamber has a solution outflow opening that releases the fluid from the liquid outlet chamber;

a second heat exchanger that defines a first solution flow path and a second solution flow path, wherein the fluid discharged from the pump system passes through the first solution flow path before entering the solution inlet of the generator and the fluid leaving the liquid outlet chamber via the solution outflow opening passes through the second solution path; and a common dividing wall interposed between the liquid level sensing chamber and the liquid outlet chamber, wherein the common dividing wall defines a hole that is smaller than the first opening and is open to the liquid level sensing chamber and the liquid outlet chamber.

* * * * *